US011261757B2

(12) United States Patent
Fryer

(10) Patent No.: US 11,261,757 B2
(45) Date of Patent: Mar. 1, 2022

(54) BOSS FOR GAS TURBINE ENGINE

(71) Applicant: PRATT & WHITNEY CANADA CORP., Longueuil (CA)

(72) Inventor: Michael A. Fryer, Oakville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 15 days.

(21) Appl. No.: 16/854,099

(22) Filed: Apr. 21, 2020

(65) Prior Publication Data

US 2021/0172341 A1 Jun. 10, 2021

Related U.S. Application Data

(60) Provisional application No. 62/943,847, filed on Dec. 5, 2019.

(51) Int. Cl.
*F01D 25/24* (2006.01)

(52) U.S. Cl.
CPC ..... *F01D 25/24* (2013.01); *F05D 2240/14* (2013.01)

(58) Field of Classification Search
CPC ..... F01D 25/24; F05D 2240/14
See application file for complete search history.

(56) References Cited

U.S. PATENT DOCUMENTS

| | | | | |
|---|---|---|---|---|
| 5,634,767 | A * | 6/1997 | Dawson | F01D 25/246 415/134 |
| 8,152,451 | B2 * | 4/2012 | Manteiga | F01D 9/02 415/115 |
| 8,177,488 | B2 * | 5/2012 | Manteiga | F01D 25/18 415/142 |
| 8,371,812 | B2 * | 2/2013 | Manteiga | F01D 25/28 415/209.3 |
| 8,672,609 | B2 | 3/2014 | Lussier et al. | |
| 9,863,261 | B2 * | 1/2018 | Chuong | F01D 25/28 |
| 10,240,532 | B2 * | 3/2019 | Scott | F02C 7/12 |
| 10,458,333 | B2 | 10/2019 | Niggemeier et al. | |
| 2012/0023967 | A1 * | 2/2012 | DeDe | F02C 7/20 60/796 |
| 2013/0224012 | A1 * | 8/2013 | Durocher | F01D 25/28 415/213.1 |
| 2016/0208699 | A1 * | 7/2016 | Cherolis | F01D 25/28 |
| 2019/0101022 | A1 | 4/2019 | Quach et al. | |
| 2019/0234310 | A1 * | 8/2019 | Morenko | F02C 7/222 |

* cited by examiner

*Primary Examiner* — Igor Kershteyn
(74) *Attorney, Agent, or Firm* — Norton Rose Fulbright Canada LLP

(57) ABSTRACT

A boss for a case of a gas turbine engine, has: an elongated body having a proximal end securable to the case, the elongated body extending from the proximal end along a boss axis to a distal end, and a flange secured to the elongated body at the distal end, the flange securable to an accessory.

20 Claims, 3 Drawing Sheets

BOSS FOR GAS TURBINE ENGINE

CROSS-REFERENCE TO RELATED APPLICATIONS

This application claims priority from U.S. patent application 62/943,847 filed on Dec. 5, 2019, the entire contents of which are incorporated by reference herein.

TECHNICAL FIELD

The application relates generally to gas turbine engines and, more particularly, to bosses of cases, such as gas generator cases, used in such engines.

BACKGROUND OF THE ART

Gas turbine engines have cases, such as gas generator cases, that extend around different components, such as combustors. A gas generator case is used to support the combustor and other components, such as manifolds used for supplying fuel to the combustor. While prior art gas generator cases may be suitable for their intended purposes, improvements in the aerospace industry are desirable.

SUMMARY

In one aspect, there is provided a boss for a case of a gas turbine engine, comprising: an elongated body having a proximal end securable to the case, the elongated body extending from the proximal end along a boss axis to a distal end, and a flange secured to the elongated body at the distal end, the flange securable to an accessory.

In another aspect, there is provided a case assembly for a gas turbine engine, comprising a case circumferentially extending about a central axis; and a boss secured to the case, the boss having a flange for securing an accessory, the flange secured to the case via an elongated body protruding away from the case along a boss axis.

DESCRIPTION OF THE DRAWINGS

Reference is now made to the accompanying figures in which.

DETAILED DESCRIPTION

Figure 1:
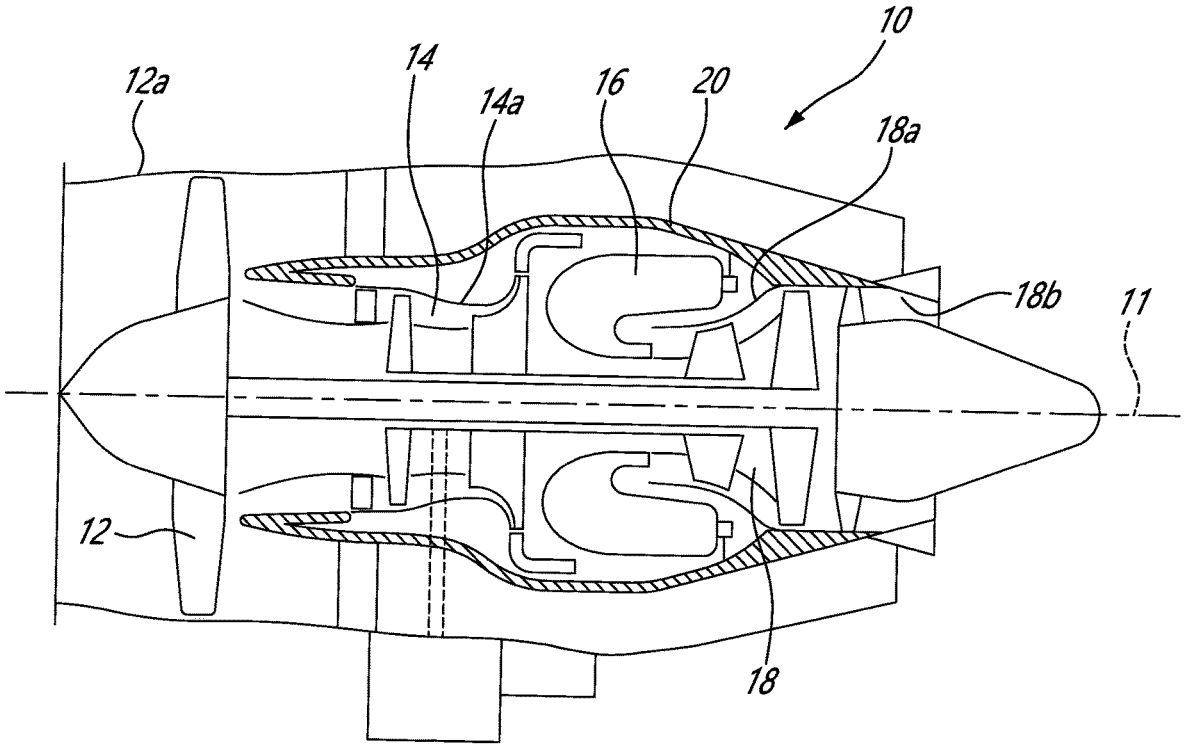
FIG. 1 is a schematic cross sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The fan 12, the compressor section 14, and the turbine section 18 are rotatable about a central axis 11 of the gas turbine engine 10.

Figure 2:
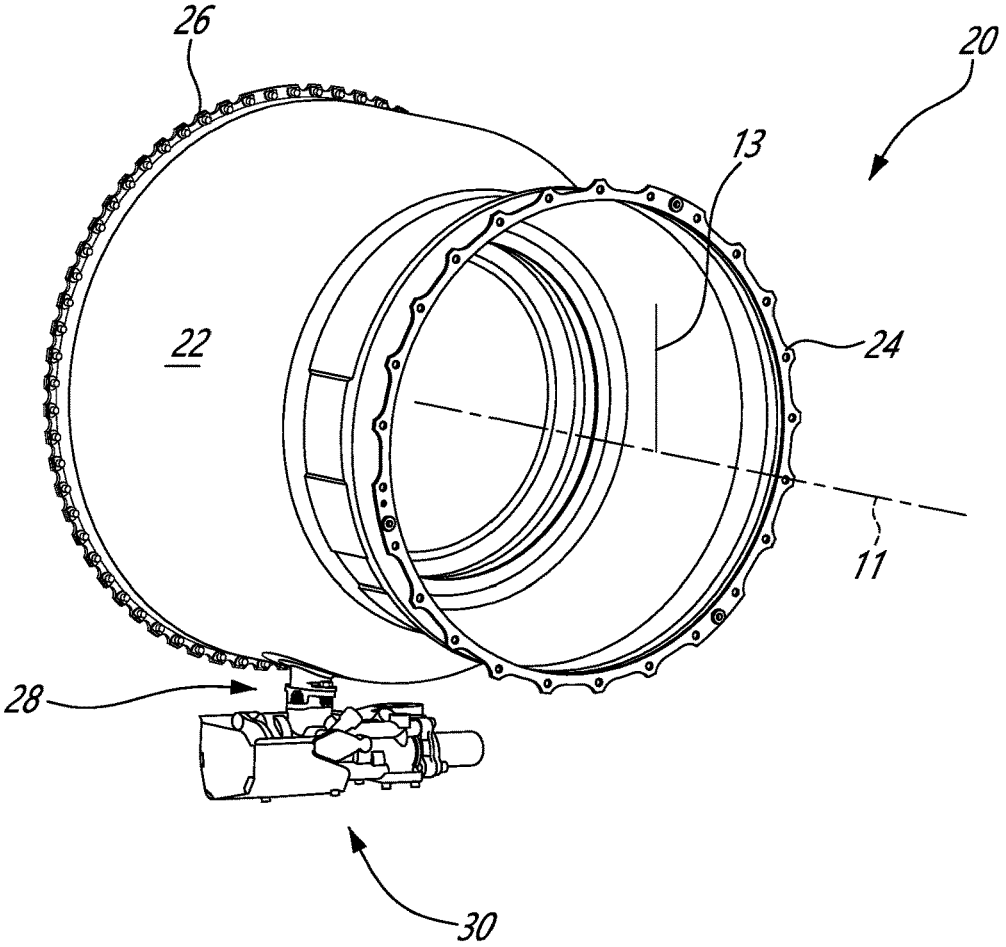
FIG. 2 is a schematic three dimensional view of a case of the gas turbine engine of FIG. 1.

The engine 10 typically comprises a segmented case assembly. For instance, the engine may comprise a fan case 12*a*, a compressor case 14*a*, a gas generator case assembly 20, a turbine case 18*a* and a turbine exhaust case 18*b*. The compressor, gas generator, turbine, and turbine exhaust cases 14*a*, 20, 18*a*, 18*b* may be axially interconnected about the centerline of the engine 10. FIG. 2 illustrates the gas generator case 20 in accordance with one embodiment.

Referring to FIG. 2, the gas generator case assembly 20 is configured to circumferentially extend around the combustor 16 (FIG. 1) and comprises an annular or cylindrical case 22 extending axially between a front mounting flange 24 and a rear mounting flange 26. According to one possible application where the gas generator case assembly 20 surrounds a hot section of the engine, the case 22 and the flanges 24 and 26 may be made of nickel alloys or other materials having suitable thermal resistance properties. In cold sections of the engine (e.g. fan and compressor section), the case could be made of other materials; such as aluminium. Depending on the applications, the case 22 may be made from sheet metal in order to minimize the weight of the engine. One or more sheet metal parts may be rolled and welded to create a cylinder. The front and rear flanges 24 and 26 may then be welded to the opposed ends of the cylinder to complete the assembly of the case 22.

One or more bosses 28, only one being shown herein, may be secured to the case 22 of the engine 10. The boss 28 may project outwardly from a radially outer face of the case 22. The boss 28 may be used for securing components to the case 22. These components may include, for instance, air/oil line connections, mounting equipment such as thermocouples and sensors. This is not intended to constitute an exhaustive list of all possible applications. In the embodiment shown, the boss 28 is used for securing an accessory, such as a flow divider valve 30, to the case 22. Such a valve 30 may be used to split a flow of fuel from a fuel source to different injectors of the combustor 16 (FIG. 1). Similar bosses may be used with other cases (e.g., turbine exhaust case) of the gas turbine engine 10. It is understood that the boss 28 may be used to secure any type of accessories.

Some bosses are defined by a local thickness increase of a material of the case 22 and may define threaded apertures for securing the flow divider valve 30 (or other components). In these cases, the valve 30 would remain very close to the case 22. It has been observed that such proximity between the valve 30 and the case 22 may allow the valve 30 to transmit loads to the case 22. These loads may reduce the lifespan of the case 22. More specifically, the case 22 may be subject to low-cycle fatigue caused by high dynamic loads, which may decrease the lifespan of a connection between the boss and the case 22. A boss in accordance with one embodiment that may at least partially alleviate the above-mentioned problems is described with reference to FIGS. 3-6.

Figure 3:
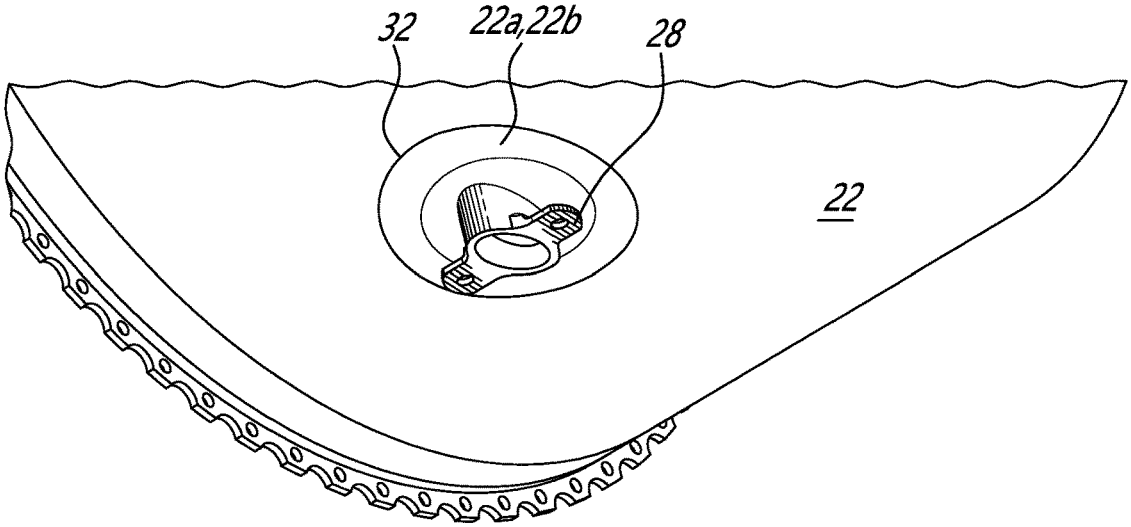
FIG. 3 is an enlarged view of a portion of FIG. 2 illustrating a boss in accordance with one embodiment.

Referring to FIG. 3, the case 22 of the case assembly 20 may define an aperture 22*a* configured to receive the boss 28. The boss 28 may be secured to the case 22 via a weld joint 32. It is understood that the case 22 need not define an aperture and that the boss 28 may be secured directly on a radially outer face of the case 22.

Figure 4:
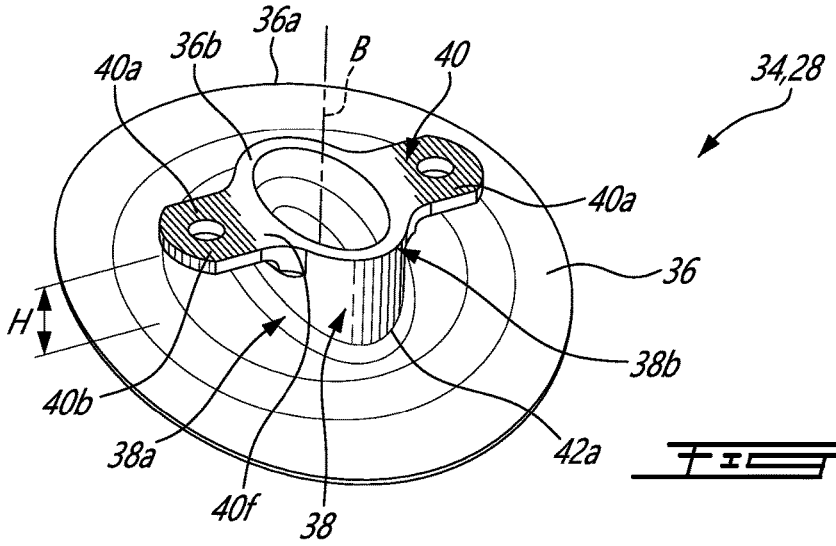
FIG. 4 is a schematic top three dimensional view of the boss of FIG. 3.
Figure 5:
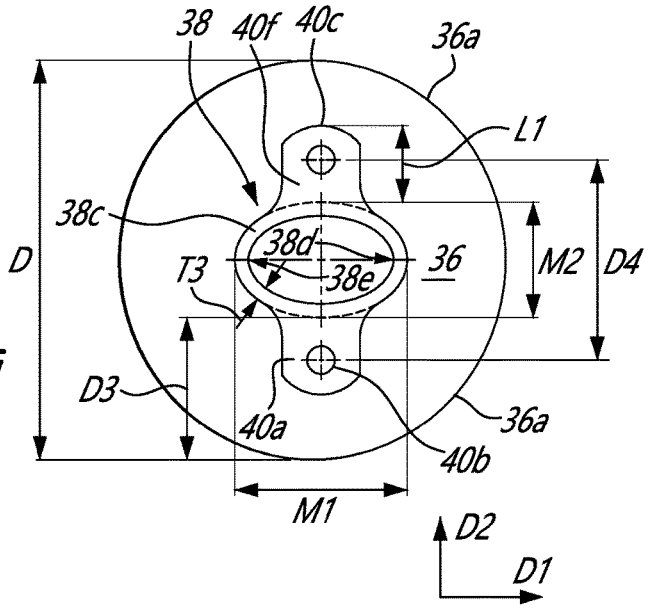
FIG. 5 is a schematic top view of the boss of FIG. 3.
Figure 6:
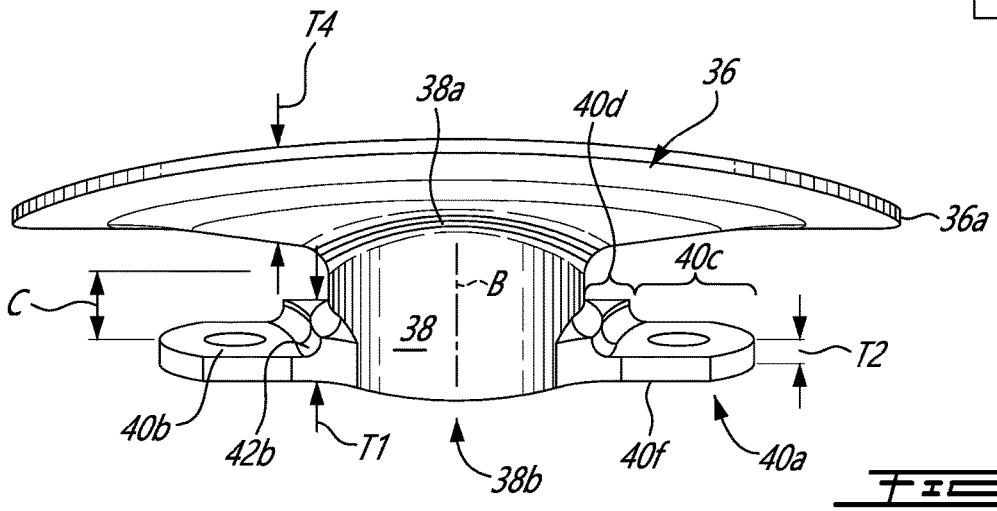
FIG. 6 is a schematic side view of the boss of FIG. 3.

Referring to FIGS. 4-6, the boss 28 is shown in greater detail. In the embodiment shown, the boss 28 defines a skirt 36, an elongated body 38, and an attachment member, or flange, 40 via which the flow divider valve 30 may be secured to the case 22. In the depicted embodiment, when the boss 28 is secured to the case 22, the skirt 36 may define a portion of the case 22 of the case 20. The skirt 36 has a peripheral edge 36*a* configured to be secured to a peripheral wall 22*b* (FIG. 3) of the aperture 22 defined through the case 22. The skirt 36 may have a circular shape and has a diameter D (FIG. 5).

In the embodiment shown, the skirt 36 has a tapered shape. That is, a thickness T4 (FIG. 6) of the skirt 36 decreases in a radial direction relative to the boss axis B and away from the boss axis B. In other words, the thickness T4 of the skirt 36 taken in a radial direction relative to the central axis 11 is greater at a location where the skirt 36 meets the elongated body 38, and the thickness T4 corresponds to that of the case 22 at the peripheral edge 36*a*.

It is understood that, alternatively, the boss 28 may include solely the elongated body 38 and the attachment member 40. The elongated body 38 may be secured at a proximal end, also referred to as a base, 38*a* thereof to the case 22 and at a distal end 38*b* to the attachment member 40. The elongated body 38 has a height H from the proximal end 38*a* to the distal end 38*b*. Herein, the proximal end 38*a* of the elongated body 38 is secured to the skirt 36. A fillet 42*a* may be located between the elongated body 38 and the skirt 36. The height H is selected in function of different factors: (i) depending on the method of manufacture, sufficient space is required between the underside of the flanges and the tapered skirt of the boss to machine the underside of the flanges; (ii) the height H of the elongated body 38 is selected to provide sufficient space for the fixings i.e. bolts, nuts, etc. to attach the accessory hardware; (iii) in function of a correlation between the distance of the flange bolt holes 40*b* and height H to account for both (i) and (ii). It will be appreciated that the greater the distance D4 (FIG. 5) between the bolt holes 40*b* of the flange 40, the greater is the distance (e.g., clearance C) along the boss axis B between the flange 40 at the holes 40*b* and the skirt 36 because of the tapering shape of the skirt 36 described above. In other words, the height H could be proportionally reduced based on the parameters of (i) and (ii) and in function of an increase in the distance D4 between the bolt holes 40*b*.

In the embodiment shown, the elongated body 38 of the boss 28 protrudes from the skirt 36 along a boss axis B. The boss axis B may be perpendicular to the skirt 36. In the embodiment shown, the boss axis B defines an angle that is selected to allow sufficient space underside the flanges to machine the underside of the flanges.

Referring more particularly to FIG. 5, the elongated body 38 of the boss 28 may have an elliptical shape. More specifically, a cross-section of the elongated body 38 taken along a plane normal to the boss axis B may have an elliptical shape. The elongated body 38 of the boss 28 has a width M1 taken in a first direction D1 and a length M2 taken in a second direction D2 being perpendicular to the first direction D1. Both of the first and second directions D1 and D2 may be perpendicular to the boss axis B. In the embodiment shown, the width M1 of the elongated body 38 is greater than the length M2. In the embodiment shown, a ratio of the width M1 to the length M2 of the elongated body 38 may range from about 1.2 to about 1.6, preferably 1.489. A ratio of the diameter D of the skirt 36 to the length M2 is about 3.18. Herein, "about" implies a variation of plus or minus 10%. In the embodiment shown, a cross-sectional area of the skirt 36 taken along a plane normal to the boss axis B is greater than that of the elongated body 38. This may allow to better distributing the loads imparted on the case 22 by the boss 28. A cross-sectional area of the boss 28 taken along a plane normal to the boss axis B is greater at the attachment member 40 than at the elongated body 38 between the proximal and distal ends 38*a*, 38*b*.

In the embodiment shown, the cross-section of the elongated body 38 taken along the plane normal to the boss axis B has an elliptical shape along a majority of the height H of the elongated body. Herein, "majority" implies more than 50% or more. In a particular embodiment, the cross-section of the elongated body 38 has an elliptical shape along an entirety of the height H of the elongated body 38.

In the embodiment shown, the elongated body 38 includes a wall 38*c* extending circumferentially all around the boss axis B. In other words, the elongated body 38 is be hollow, but may alternatively be solid. The body 38 may have a greater compliance by being hollow than by being solid. The wall 38*c* has a thickness T3.

Referring to FIGS. 3 and 5, the boss 28 may be secured to the case 22 such that the width M1 of the elongated body 38 of the boss 28 is oriented substantially parallel to a circumferential direction relative to the central axis 11 of the engine 10. In other words, the first direction D1 may correspond to a circumferential direction of the case 22 relative to the central axis 11. This may allow to increase a distance D3 (FIG. 5) between the weld joint 32 at the perimeter 36*a* of the skirt 36 and the elongated body 38 of the boss 28 compared to a configuration in which the elongated body has a circular cross-section of the same cross-sectional area. The distance D3 is taken in an axial direction relative to the central axis 11 of the engine 10. This may improve compliance and transition between the stiffened region adjacent to the elongated body 38 to the case 22 adjacent to the weld joint 32

In the present embodiment, an axial bending stiffness of the boss 28 may be less than a circumferential bending stiffness of the boss 28. In other words, it may require less force to displace the distal end 38*b* of the elongated body 38 in an axial direction relative to the central axis 11 (FIG. 2) of the casing assembly 20 than to displace the distal end 38*b* of the body 38 in a circumferential direction relative to the central axis 11. Although an elliptical shape is depicted herein, any other shapes presenting this difference in axial/circumferential bending stiffness are contemplated, such as, rectangular, oval, trapezoidal, and so on.

During operation, the engine 10 (FIG. 1) may be subjected to acceleration/deceleration mainly occurring in the axial direction relative to the central axis 11. Therefore, having the elongated body 38 distancing the valve 30 from the case 22 may help in decreasing a magnitude of the loads transmitted from the valve 30 to the case 22. Moreover, having the axial bending stiffness less than the circumferential bending stiffness may further help in decreasing the magnitude of the loads transmitted from the valve 30 to the case 22. In other words, the elongated body 38 may act as a damper to attenuate the magnitude of the loads created by the acceleration/deceleration of the engine 10, and, consequently, of the valve 30. The magnitude of the loads transmitted from the valve 30 to the case 22 may decrease with an increase in the height H of the elongated body and with an increase in a width-to-length (M1/M2) ratio of the elongated body 38.

Distancing the mounding face (e.g., attachment member 40) from the case 22, which is done herein by the use of the elongated body 38, may provide compliance and may attenuate forces being applied to the case 22 by the accessory 30. A lifespan of the boss/case may be increased using the disclosed boss 28.

Referring to FIGS. 4-6, in the depicted embodiment, the attachment member 40 is spaced apart from the skirt 36 and includes two flange portions 40*a* each defining an aperture 40*b* configured for receiving bolts for securing the flow divider valve 30 to the boss 28. In the embodiment shown, the two flange portions 40*a* are diametrically opposed from one another. Other configurations are contemplated. The flange portions 40*a* may have a length L1 (FIG. 5) extending from the distal end 38*b* of the elongated body 38 to an extremity 40*c* (FIG. 5) of the flange 40*a*.

Referring to FIG. 6, each of the flange portions 40*a* has a base portion 40*d* and a tip portion 40*e* protruding from the base portion 40*d*. The base portion 40*d* is secured to the elongated body 38 and the tip portion 40*e* protrudes from the main portion 40*d*. In the embodiment shown, a thickness T1 of the base portion 40*d* is greater than a thickness T2 of the tip portion 40*e*. Having the tip portion 40*e* of a lesser thickness than the base portion 40*d* may increase a clearance, or gap, C between the flange portions 40*a* and the skirt 36 (or case 22) to allow a manufacturing tool to access and machine the elongated body 38 of the boss 28. In the embodiment shown, a fillet 42*b* is located at an intersection between the base portion 40*d* and the tip portion 40*e*. Moreover, the tapered shape of the skirt 36 described above is such that the clearance C increases in a radial direction relative to the boss axis B and away therefrom. In other words, the clearance C is greater proximate the peripheral edge 36*a* of the skirt 36 than where the skirt 36 meets the elongated body 38. Moreover, the gap C defined between the attachment member 40 and the skirt 36 or casing 22 may allow for a tool to be inserted therebetween for fastening the valve 30 to the attachment member 40. In a particular embodiment, varying the flange thicknesses allows to change or tune the stiffness of the boss. It will be appreciated that, although two flanges were shown, other configurations using more than two flanges (e.g, 3, 4 flanges), or only one flange, are contemplated.

Referring to FIGS. 2 and 5, in the depicted embodiment, the attachment member 40 defines a mounting or attachment face 40*f* that faces away from the case 22. The mounting face 40*f* is the face against which the accessory (e.g., valve 30) may be in abutment. As shown more clearly in FIG. 2, the mounting face 40*f* is non-parallel to the skirt 36. Stated differently, the height H of the elongated body 38 may vary from a first circumferential end 38*d* of the elongated body 38 to a second circumferential end 38*e* of the elongated body 38 opposed the first circumferential end 38*d*. In the embodiment shown, the boss axis B is substantially transverse to the central axis 11, but the two axes B, 11 do not intersect each other. In other words, the boss is offset to the side of the engine vertical axis 13 (FIG. 2) (e.g., radial direction relative to the central axis 11). A location of the boss axis B may range from being aligned with the engine vertical axis 13, in which case the boss axis B intersects the central axis 11, to being tangent to the case 22. In other words, a main component of a direction of the boss axis B ranges from being radial to circumferential relative to the central axis 11.

As shown in FIG. 5, the two flange portions 40*a* protrudes from the longest sides of the elongated body 38, that is, from the sides having the width M1 greater than the length M2. In other words, the flange portions 40*a* extend axially relative to the central axis 11 (FIG. 2) of the casing assembly 20. Having the elongated body 38 being elliptical in cross-section instead of circular may increase the length L1 of the flange portions 40*a* supported off each side of the elongated body 38 compared to a configuration in which the elongated body 38 is circular and of the same cross-sectional area. More specifically, the distance between the apertures 40*b* defined through the flange portions 40*a* may be dictated by the component (e.g., valve 30) to be secured to the flange portions 40*a*. Having the elongated body 38 being elliptical may allow to increase a distance between the apertures 40*b* and the elongated body 38 compared to a configuration in which the elongated body has a circular cross-section of equal area. The stiffness of the flange portions 40*a* may be decreased by increasing the distance between the apertures 40*b* of the flange portions 40*a* and the elongated body 38. This may help in reducing stiffness and in improving the compliance and in reducing the impact of the dynamic loads on installed system (e.g., flow divider valve).

In the present embodiment, the attachment member 40 and the elongated body 38 are parts of a monolithic body 34. In the embodiment shown, the monolithic body 34 further includes the skirt 36. Herein, "monolithic" may mean that the boss 28 may be machined from a single block of material. Manufacturing of the boss 28 may be achieved by conventional milling and micro-milling from an appropriate solid base material. Additive Manufacturing or 3D printing could be employed. The truncated flange portions or profiled flanges 40*a* may provide improved access to the region between the underside of the attachment member 40 and the skirt 36 of the boss 28. This may allow for the micro milling operations to be performed between the flange portions 40*a* and the case 22 to generate the elliptical form of the boss's elongated body 38. The profiled flanges 40*a* may aid in finish machining for the underside of the flange portions 40*a*.

Embodiments disclosed herein include:

A. A boss for a case of a gas turbine engine, comprising: an elongated body having a proximal end securable to the case, the elongated body extending from the proximal end along a boss axis to a distal end, and a flange secured to the elongated body at the distal end, the flange securable to an accessory.

B. A case assembly for a gas turbine engine, comprising a case circumferentially extending about a central axis; and a boss secured to the case, the boss having a flange for securing an accessory, the flange secured to the case via an elongated body protruding away from the case along a boss axis.

Embodiments A and B may include any of the following elements in any combinations:

Element 1: a cross-section of the elongated body taken along a plane normal to the boss axis of the boss has an elliptical shape. Element 2: the elongated body has a width taken in a first direction normal to the boss axis and a length taken in a second direction normal to the boss axis and normal to the first direction, a ratio of the width to the length being at least about 1.2. Element 3: the boss includes a skirt secured to the proximal end of the elongated body, the boss securable to the case via a perimeter of the skirt. Element 4: a cross-sectional area of the skirt taken along a plane normal to the boss axis is greater than that of the elongated body. Element 5: a fillet at a junction between the elongated body and the skirt. Element 6: the flange includes two flange portions protruding radially outwardly from the distal end of the elongated body relative to the boss axis. Element 7: each of the two flange portions includes a base portion and a tip portion, the base portion secured to the elongated body and the tip portion protruding from the base portion, a thickness of the base portion greater than that of the tip portion. Element 8: a fillet is defined at an intersection between the base portion and the tip portion, the fillet located in a side of the flange facing the case. Element 9: the tip portions define apertures for securing the accessory, the apertures radially offset from the elongated body relative to the boss axis. Element 10: a cross-section of the elongated body taken along a plane normal to the boss axis of the boss has an elliptical shape along a majority of a height of the elongated body between the proximal and distal ends. Element 11: the cross-section of the elongated body has an elliptical shape along an entirety of the height of the elongated body. Element 12: a cross-sectional area of the boss taken along a plane normal to the boss axis is greater at the flange than at the elongated body between the case and the flange. Element 13: the cross-section of the elongated body taken along the plane normal to the boss axis has an elliptical shape having a width taken in a circumferential direction relative to the central axis and a length taken in an axial direction, the width greater than the length. Element 14: the elongated body is secured to the case via a skirt of the boss, the boss secured to the case via a perimeter of the skirt. Element 15: a cross-sectional area of the skirt taken along the plane normal to the boss axis is greater than that of the elongated body. Element 16: the flange includes two flange portions protruding radially away from the elongated body relative to a boss axis, the two flange portions axially spaced apart from the case relative to the boss axis. Element 17: comprising the accessory secured to the flange of the boss. Element 18: the accessory is a flow divider valve.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A boss for a case of a gas turbine engine, comprising: an elongated body having a proximal end securable to the case, the elongated body extending from the proximal end along a boss axis to a distal end, and a flange secured to the elongated body at the distal end, the flange securable to an accessory, the elongated body having a width taken in a first direction normal to the boss axis and a length taken in a second direction normal to the boss axis and normal to the first direction, the width greater than the length.

2. The boss of claim 1, wherein a cross-section of the elongated body taken along a plane normal to the boss axis of the boss has an elliptical shape.

3. The boss of claim 1, wherein a ratio of the width to the length being at least about 1.2.

4. The boss of claim 1, wherein the boss includes a skirt secured to the proximal end of the elongated body, the boss securable to the case via a perimeter of the skirt.

5. The boss of claim 4, wherein a cross-sectional area of the skirt taken along a plane normal to the boss axis is greater than that of the elongated body.

6. The boss of claim 4, further comprising a fillet at a junction between the elongated body and the skirt.

7. The boss of claim 1, wherein the flange includes two flange portions protruding radially outwardly from the distal end of the elongated body relative to the boss axis.

8. The boss of claim 7, wherein each of the two flange portions includes a base portion and a tip portion, the base portion secured to the elongated body and the tip portion protruding from the base portion, a thickness of the base portion greater than that of the tip portion.

9. The boss of claim 8, wherein a fillet is defined at an intersection between the base portion and the tip portion, the fillet located in a side of the flange facing the case.

10. The boss of claim 8, wherein the tip portions define apertures for securing the accessory, the apertures radially offset from the elongated body relative to the boss axis.

11. The boss of claim 1, wherein a cross-section of the elongated body taken along a plane normal to the boss axis of the boss has an elliptical shape along a majority of a height of the elongated body between the proximal and distal ends.

12. The boss of claim 11, wherein the cross-section of the elongated body has an elliptical shape along an entirety of the height of the elongated body.

13. A case assembly for a gas turbine engine, comprising a case circumferentially extending about a central axis; and a boss secured to the case, the boss having a flange for securing an accessory, the flange secured to the case via an elongated body protruding away from the case along a boss axis, a cross-section of the elongated body taken along the plane normal to the boss axis having an elliptical shape.

14. The boss of claim 13, wherein the cross-sectional area of the boss is greater at the flange than at the elongated body between the case and the flange.

15. The case assembly of claim 14, wherein the cross-section has a width taken in a circumferential direction relative to the central axis and a length taken in an axial direction, the width greater than the length.

16. The case assembly of claim 15, wherein the elongated body is secured to the case via a skirt of the boss, the boss secured to the case via a perimeter of the skirt.

17. The case assembly of claim 16, wherein a cross-sectional area of the skirt taken along the plane normal to the boss axis is greater than that of the elongated body.

18. The case assembly of claim 17, wherein the flange includes two flange portions protruding radially away from the elongated body relative to a boss axis, the two flange portions axially spaced apart from the case relative to the boss axis.

19. The case assembly of claim 13, comprising the accessory secured to the flange of the boss.

20. The case assembly of claim 19, wherein the accessory is a flow divider valve.

* * * * *